US008967033B1

(12) United States Patent
O'Brien

(10) Patent No.: US 8,967,033 B1
(45) Date of Patent: Mar. 3, 2015

(54) CONCENTRIC CYLINDER GAS-OPERATED AUTOMATIC FIREARM

(71) Applicant: J Patrick O'Brien, Duluth, GA (US)

(72) Inventor: J Patrick O'Brien, Duluth, GA (US)

( * ) Notice: Subject to any disclaimer, the term of this patent is extended or adjusted under 35 U.S.C. 154(b) by 0 days.

(21) Appl. No.: 14/274,683

(22) Filed: May 10, 2014

Related U.S. Application Data

(63) Continuation of application No. 13/156,584, filed on Jun. 9, 2011, now Pat. No. 8,752,471.

(60) Provisional application No. 61/352,929, filed on Jun. 9, 2010.

(51) Int. Cl.
*F41A 3/40* (2006.01)
*F41A 5/24* (2006.01)
*F41A 5/18* (2006.01)

(52) U.S. Cl.
CPC .... *F41A 5/24* (2013.01); *F41A 5/18* (2013.01)
USPC ..... 89/183; 89/156; 89/179; 89/191.01

(58) Field of Classification Search
CPC ..... F41A 5/18; F41A 5/24; F41B 11/72; F41B 11/62; F41B 11/55; F41B 11/57; F41B 11/00; F41B 11/52; F41B 11/50; F41B 11/51; F41B 11/56; F41B 11/54; F41B 11/646; F41B 11/73; F41B 11/642; F41B 11/681; F41B 11/721; F41B 11/83; F41B 11/89; F41B 11/64
USPC ..... 124/56–77
See application file for complete search history.

(56) References Cited

U.S. PATENT DOCUMENTS

| | | | | | |
|---|---|---|---|---|---|
| 2,151,676 | A * | 3/1939 | Appleby | 124/67 |
| 2,156,797 | A * | 5/1939 | Appleby | 124/67 |
| 2,542,777 | A * | 2/1951 | Loew | 124/67 |
| 2,583,463 | A * | 1/1952 | Boulet | 124/64 |
| 3,005,279 | A * | 10/1961 | Brewer | 42/18 |
| 3,507,067 | A * | 4/1970 | Into | 42/10 |
| 3,738,219 | A * | 6/1973 | Febres | 89/1.703 |
| 3,766,903 | A * | 10/1973 | Fischer | 124/67 |
| 3,981,093 | A * | 9/1976 | Reed | 42/105 |
| 4,270,293 | A * | 6/1981 | Plumer et al. | 42/105 |
| 4,289,109 | A * | 9/1981 | D'Andrade | 124/67 |
| 5,267,549 | A * | 12/1993 | Webber | 124/65 |
| 6,848,538 | B2 * | 2/2005 | Shafer | 181/223 |
| 7,975,683 | B1 * | 7/2011 | Williams et al. | 124/67 |
| 8,590,519 | B2 * | 11/2013 | Barish | 124/69 |
| 2004/0173403 | A1 * | 9/2004 | Shafer | 181/223 |
| 2008/0295818 | A1 * | 12/2008 | Styles et al. | 124/83 |
| 2010/0123041 | A1 * | 5/2010 | Nair et al. | 244/63 |
| 2012/0180354 | A1 * | 7/2012 | Sullivan et al. | 42/16 |
| 2013/0125440 | A1 * | 5/2013 | Zheng | 42/14 |

* cited by examiner

*Primary Examiner* — Samir Abdosh
(74) *Attorney, Agent, or Firm* — F. Wayne Thompson, Jr.

(57) ABSTRACT

A fixed-barrel, gas-operated firearm having its barrel concentrically mounted within a pressure tube enclosing substantially all of the moving parts of the firearm's action. A gas cup reciprocates under the influence of propellant gas pressure when the firearm is fired, driving slide members that link the pressure cup to the firearm's bolt rearward within the pressure tube, unlocking the breech, rotating and retracting the bolt, discharging the spent cartridge casing and then advancing the bolt to chamber a new cartridge.

16 Claims, 9 Drawing Sheets

CONCENTRIC CYLINDER GAS-OPERATED AUTOMATIC FIREARM

CROSS-REFERENCE TO RELATED APPLICATION

This is a continuation application claiming the benefit of U.S. patent application Ser. No. 13/156,584, which was filed on Jun. 9, 2011, which claims the benefit of U.S. Provisional Patent Application Ser. No. 61/352,929, filed Jun. 9, 2010, the entireties of both applications are hereby incorporated herein by reference for all purposes.

TECHNICAL FIELD

The present invention relates generally to the field of firearms, and more particularly to a gas-operated automatic firearm having a concentric tube surrounding its barrel forming a pressurized gas chamber within which a gas cup or piston is driven under the influence of pressurized gas from the propellant charge when the gun is fired to operate the bolt to discharge a spent cartridge casing and chamber a new cartridge.

BACKGROUND

Various automatic or semi-automatic firearms are known. Typically such firearms include numerous moving parts and parts that require close-tolerance machining to produce. The complexity of many such firearms can adversely affect their reliability and durability, making disassembly and cleaning difficult and time consuming, and result in high costs of production. Many such firearms also suffer from disadvantages in terms of accuracy due to their barrels moving during operation, and external moving parts can create pinch points or other user safety issues.

Accordingly, it can be seen that needs exist for continuing improvement in firearm design. It is to the provision of a gas-operated automatic firearm meeting these and other needs that the present invention is primarily directed.

SUMMARY

The present invention relates to improvements to gas-operated automatic firearms. In example embodiments, a firearm includes a pressure tube concentrically mounted about its barrel, a gas-driven cup or piston slidably mounted within the pressure tube, slides or rails extending from the gas-driven cup or piston, and a bolt actuated by the slides or rails to operate the firearm. The firearm can take various forms, including pistols or handguns, long guns such as rifles, carbines or shotguns, and may be chambered in various calibers including without limitation 9 mm, .40 caliber or .45 caliber.

In one aspect, the present invention relates to a fixed barrel, gas operated firearm. The firearm includes a pressure tube having an inner surface and an outer surface, and a barrel fixed within the pressure tube and comprising a breech end, a muzzle end, an internal bore, an external surface, and at least one gas vent extending through a wall of the barrel proximal the muzzle end. The firearm also includes an annular gas cup having an outer rim for sliding in proximity with the inner surface of the pressure tube and an inner opening for sliding in proximity with the external surface of the barrel, and at least one slide extending from the gas cap and through the pressure tube. The firearm also includes a bolt movable upon operation thereon by the at least one slide between an advanced position in engagement with the breech end of the barrel for firing of the firearm, and a retracted position away from the breech end of the barrel for discharge of a spent cartridge casing.

In another aspect, the invention relates to a firearm including a barrel having a bore extending therethrough and defining a central lengthwise barrel axis through the bore. The firearm further includes a cylindrical pressure tube surrounding the barrel and having a pressure tube axis coincident with the barrel axis.

In still another aspect, the invention relates to a firearm having a barrel concentrically mounted within a pressure tube forming an enclosure within which substantially all of the moving parts of the firearm's action are housed.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1A:
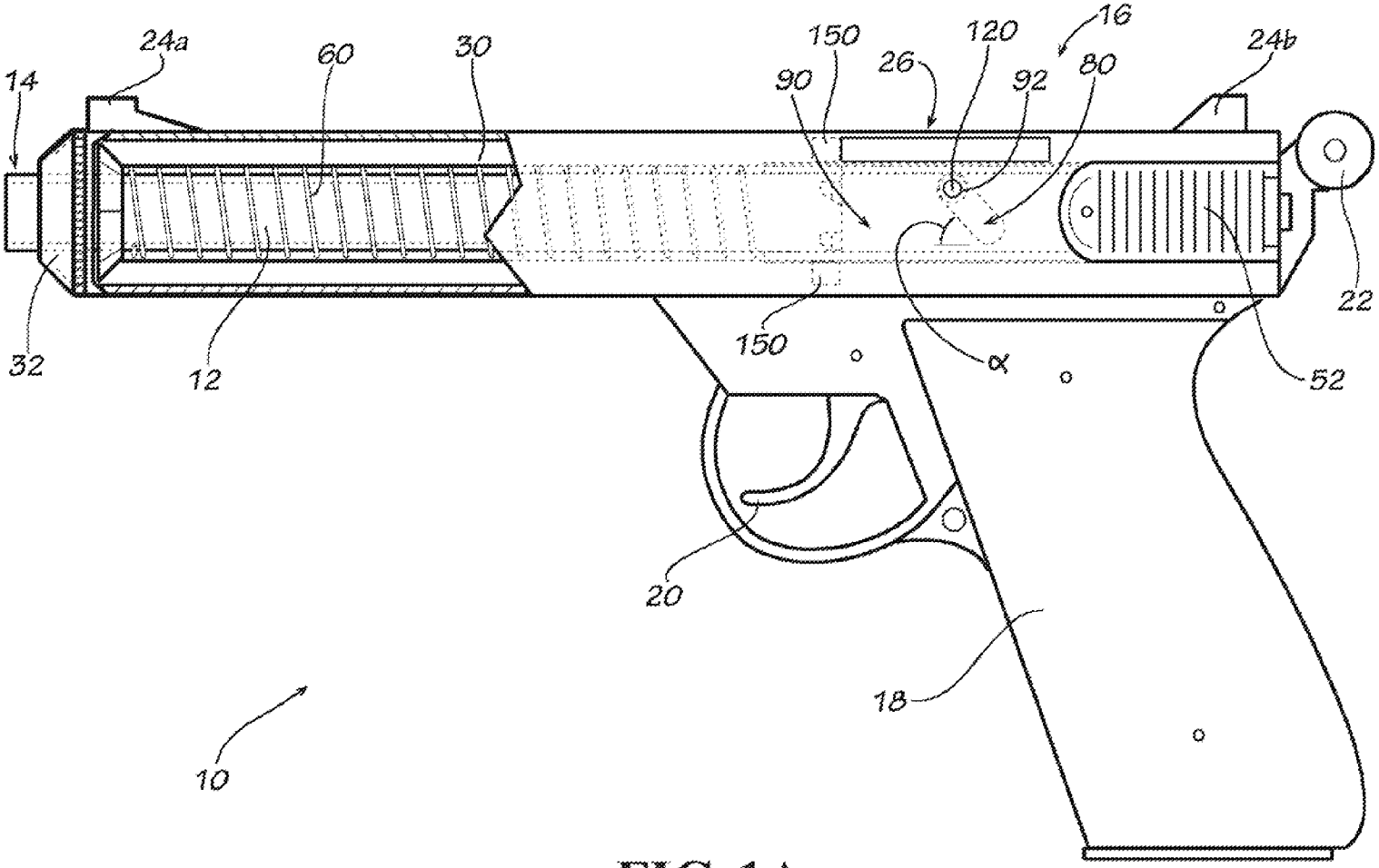
FIG. 1A is a side view of a firearm according to an example embodiment of the present invention, shown in partial cross-section.
Figure 1B:
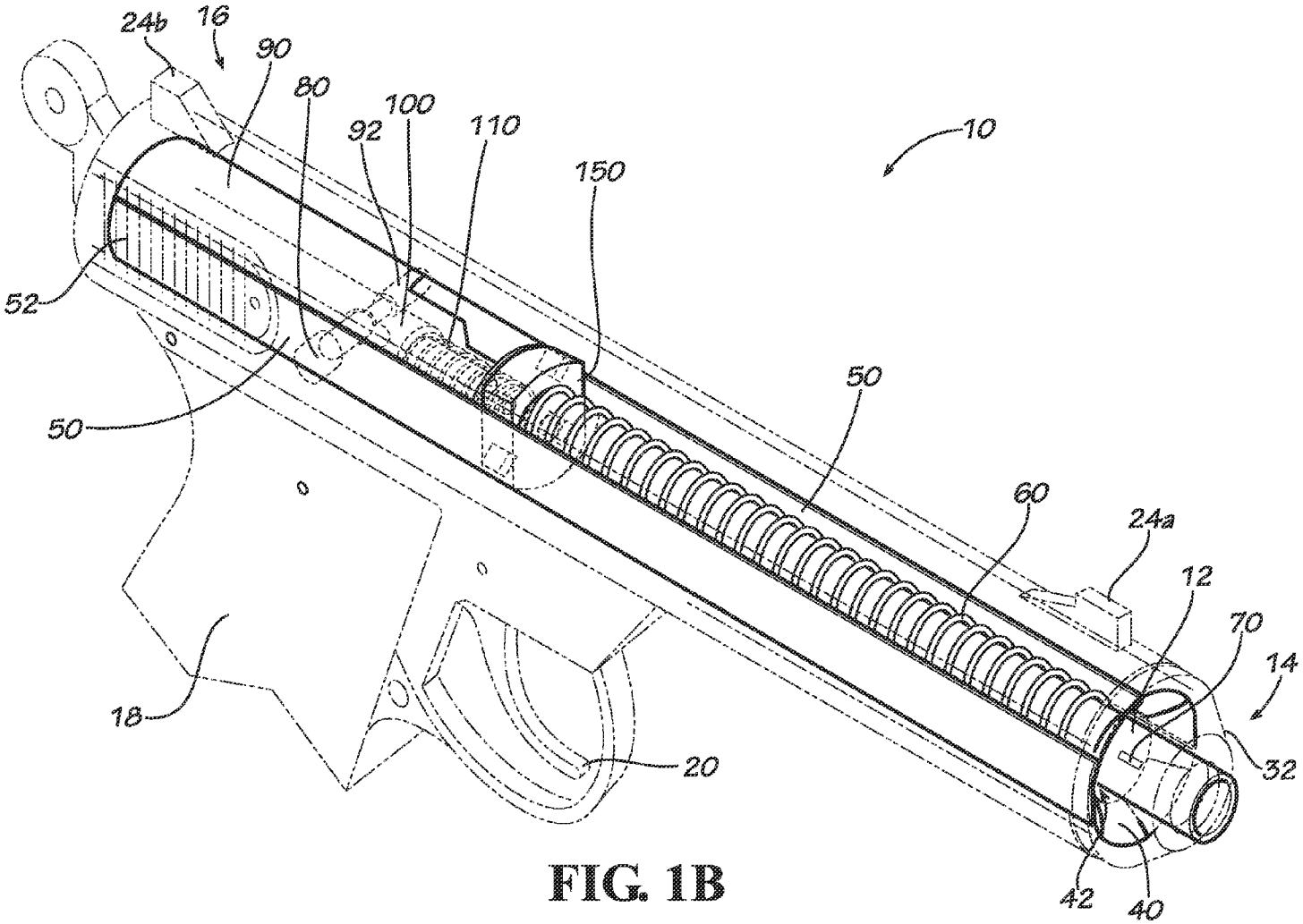
FIG. 1B is a perspective view of a firearm of FIG. 1 shown in partial cutaway.

With reference now to the drawing figures, wherein like reference numbers represent corresponding parts throughout the several views, FIGS. 1A-1B show a firearm 10 according to an example form of the invention. In the depicted form, the firearm is a handgun, but it will be understood that the invention is not so limited and may be adapted for long gun or other firearm applications. In the depicted embodiment, the firearm 10 generally comprises a pressure tube 30, a barrel 12 extending through the pressure tube, and having a front or muzzle end 14 and a rear or breech end 16, a handgrip 18, a trigger 20, an external or internal (not shown) hammer 22, and sights 24*a*, 24*b*. In alternate embodiments of the invention a decocking mechanism (not shown) may optionally be included, and the firearm may operate in single-action or double action mode.

Figure 5:
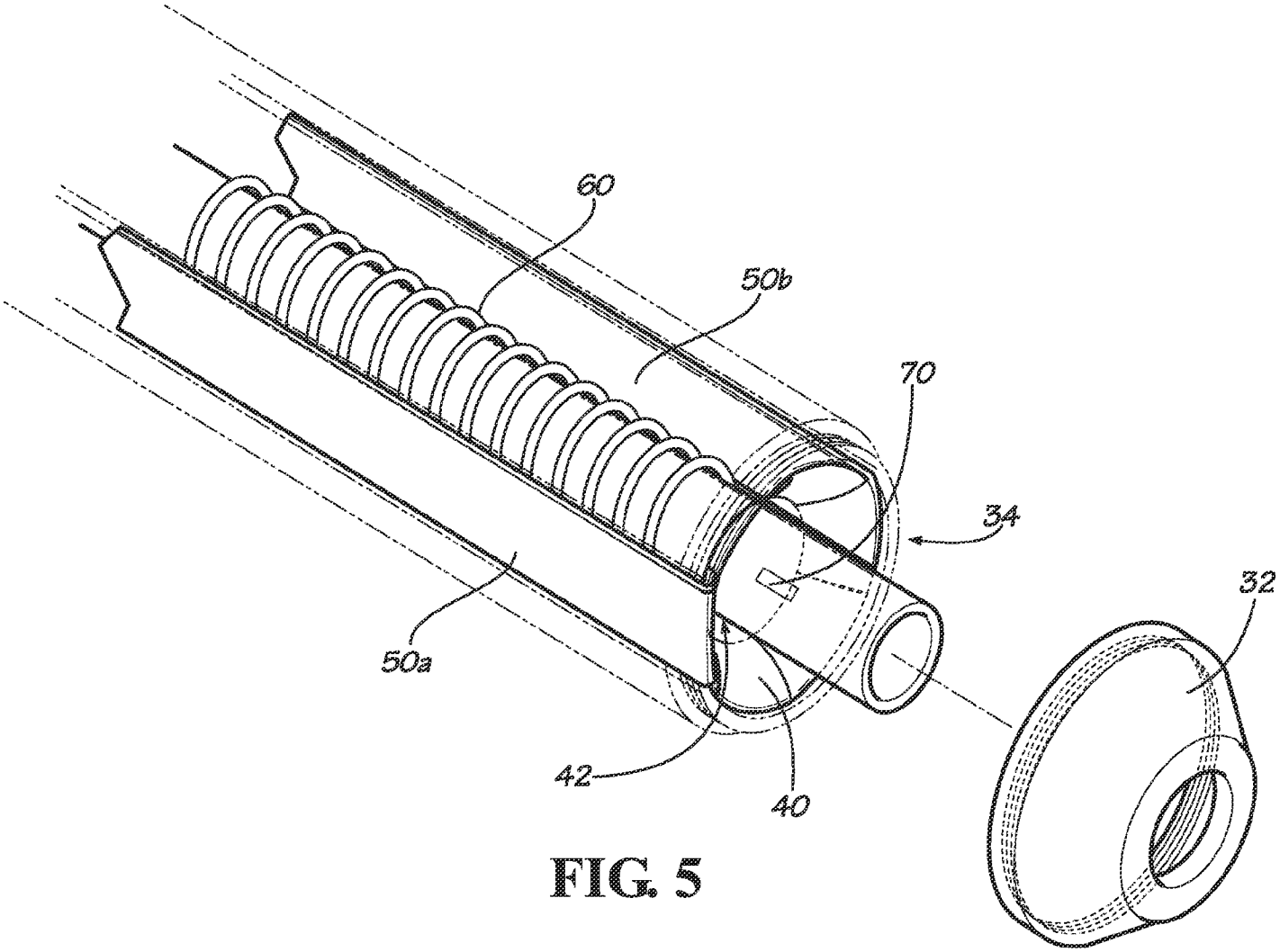
FIG. 5 is an assembly view of the muzzle end of the barrel and pressure tube of a firearm according to an example embodiment of the present invention.
Figure 6A:
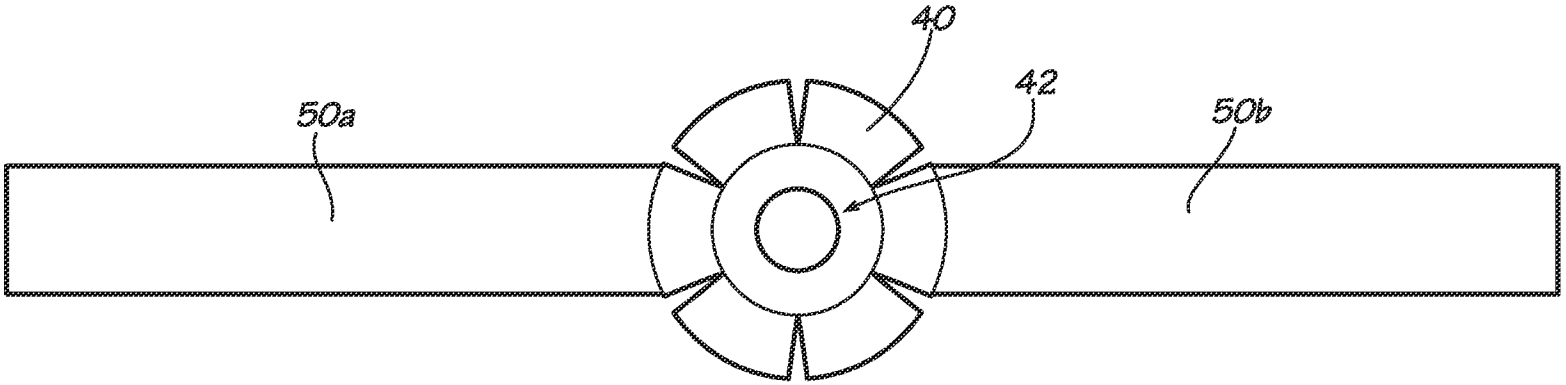
FIG. 6A is a side view of an unfinished blank for forming a gas cup and slide rail assembly according to an example embodiment of the present invention.
Figure 7A:
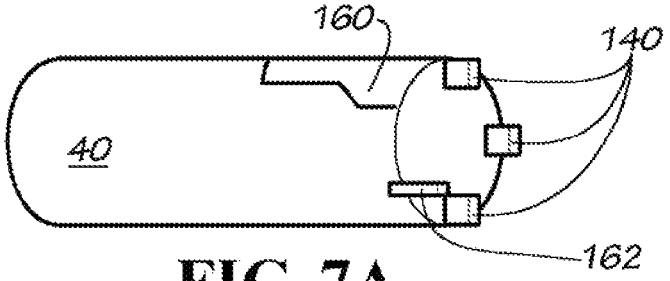
FIG. 7A shows a perspective cross-sectional view of a bolt locking assembly and extractor mechanism according to an example embodiment of the present invention.
Figure 7B:
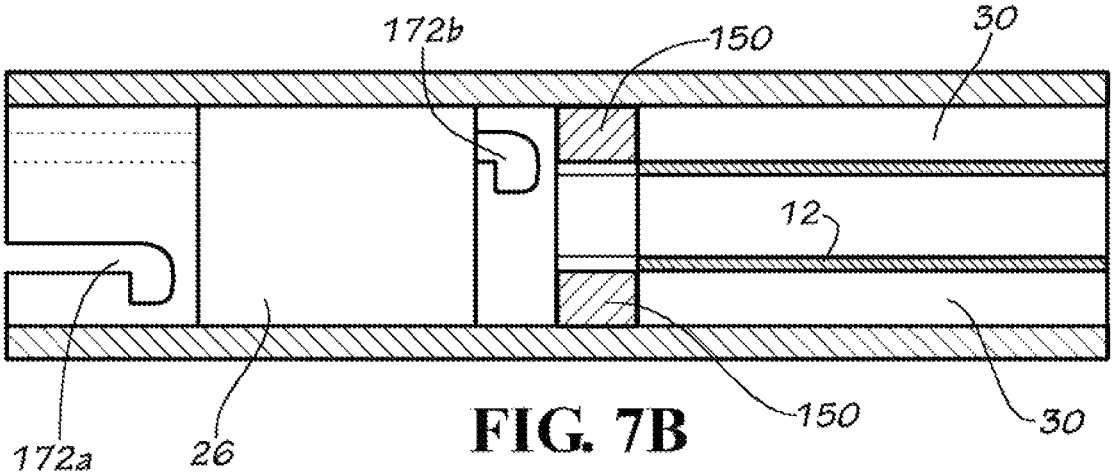
FIG. 7B shows a side cross-sectional view of a bolt locking system assembly according to an example embodiment of the present invention.
Figure 7C:
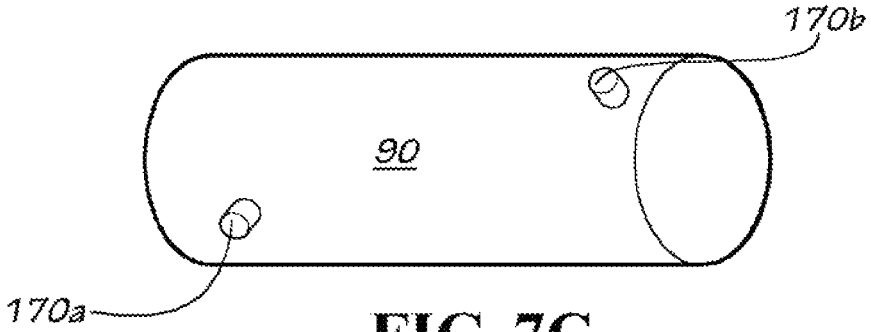
FIG. 7C shows a side perspective view of the bolt locking system of FIG. 7B.
Figure 7D:
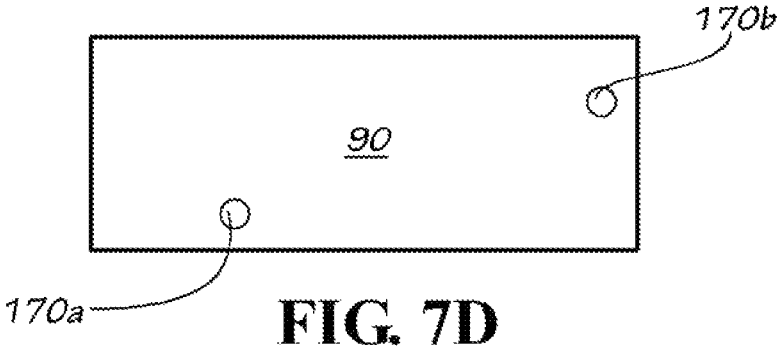
FIG. 7D shows a top view of the bolt locking system of FIG. 7C.

As shown, the barrel 12 extends concentrically through a pressure tube 30, with an annular space or peripheral channel being defined between the outer surface of the barrel and the inner surface of the pressure tube. The breech end 16 of the barrel 12 is secured with respect to a breech block 150 (shown in FIG. 7B), which is welded or otherwise affixed within the pressure tube 30 in front of the breech 26. While a threaded connection of the barrel 12 to the breech block 150 is preferable for allowing replacement of a worn barrel, the barrel may be welded or otherwise permanently mounted in alternate embodiments of the invention. A muzzle cap 32 is mounted over the open front end of the pressure tube 30, preferably by a threaded connection, to form a sealed enclosure and define a gas pressure chamber 34 (shown in FIG. 5) within the pressure tube around the barrel 12. An annular gas cup or piston 40 is slidably mounted within the gas pressure chamber 34 concentrically with the barrel 12. An internal opening or barrel hole 42 (shown in FIGS. 5 and 6A) through the gas cup 40 slides axially with a close fit along the external surface of the barrel 12, and the outer circumference of the gas cup slides with a close fit along the internal surface of the pressure tube 30.

Figure 6B:
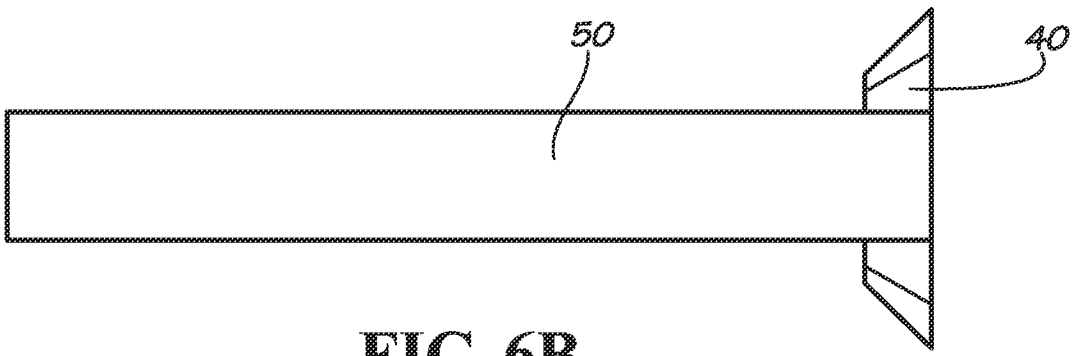
FIG. 6B shows a side view of a formed gas cup and slide rails assembly according to an example embodiment of the present invention.

First and second slide rails 50*a*, 50*b* (shown in FIGS. 5, 6A & 6B), also described as a yoke or yoke arms, extend rearwardly (toward the breech end 16) from diametrically opposed sides of the gas cup 40, forming a sleeve or sleeves. The yoke arms yoke around the outer surface of the barrel 12. As seen in example embodiments the gas cup 40 and slide rails 50A and 50B can be fabricated from a unitary flat stamping of sheet metal (FIG. 6A) that is folded or bent to form a single-piece assembly (FIG. 6B). Alternatively, a deeper gas cup (not presently shown) can have separate slides attached thereto, for example by rivets, welds, connectors or other attachment means. A barrel spring 60 biases the gas cup 40 and attached slide rails 50A and 50B toward the muzzle end 14 of the firearm 10. Raceways or guide channels 36 (shown in FIG. 4) extend lengthwise along the inner surface of the pressure tube 30 to receive and guide the slide rails 50A and 50B as the gas cup 40 moves back and forth during operation of the firearm 10.

Figure 2:
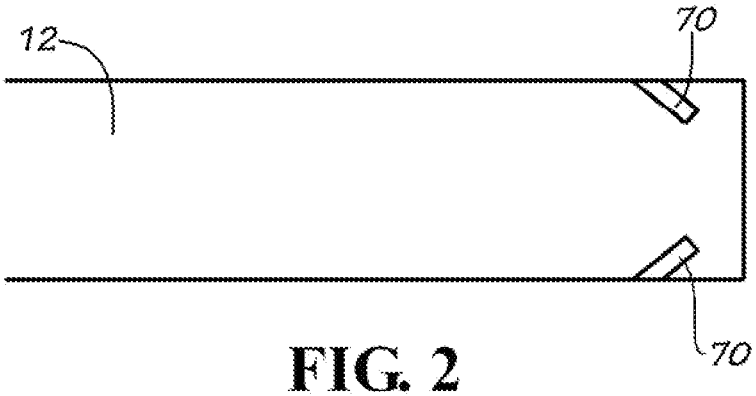
FIG. 2 shows a side view of a ported muzzle end of a barrel according to an example embodiment of the present invention.

One or more barrel vents 70 (see in FIGS. 2 and 5) are formed through the barrel 12 proximal its muzzle end 14 for delivering pressurized gas from inside the barrel outwardly into the gas pressure chamber 34 in the pressure tube 30 as a bullet passes the barrel vents upon discharge of the firearm 10, and thereby drive the gas cup 40 rearwardly to actuate the automatic action of the firearm. A plurality of barrel vents 70 can be provided in a spaced array about the circumference of the barrel 12. As shown, the barrel vents 70 are angled rearwardly away from the muzzle end 14, to direct the combustion gasses in the direction of travel of the gas cup 40. Alternatively, example vents can be situated perpendicularly to the longitudinal axis of the barrel 12.

The slide rails 50, 50A and 50B preferably include slots, grooves or other apertures 80 for rotationally unlocking and locking a bolt 90 (shown in FIGS. 1A-1B & FIGS. 7A, 7C & 7D) of the firearm 10. Preferably, at least a portion of the aperture 80 comprises an angled or inclined contact surface for interaction with a cooperating bolt retainer 92 (shown in FIG. 4) such as a pin, finger, lug or other member projecting transversely outward from the bolt 90. As the slide rails 50 are driven axially rearward toward the breech end 16 by the combustion gasses operating on the gas cup 40, the contact surface of the aperture 80 is oriented at an angle of inclination $\alpha$ relative to the axial direction of travel of the slide rail, causing the translational movement of the slide rail to impart a rotational or twisting movement to the bolt 90 via the bolt retainer 92 sliding within the aperture 80.

Figure 9A:
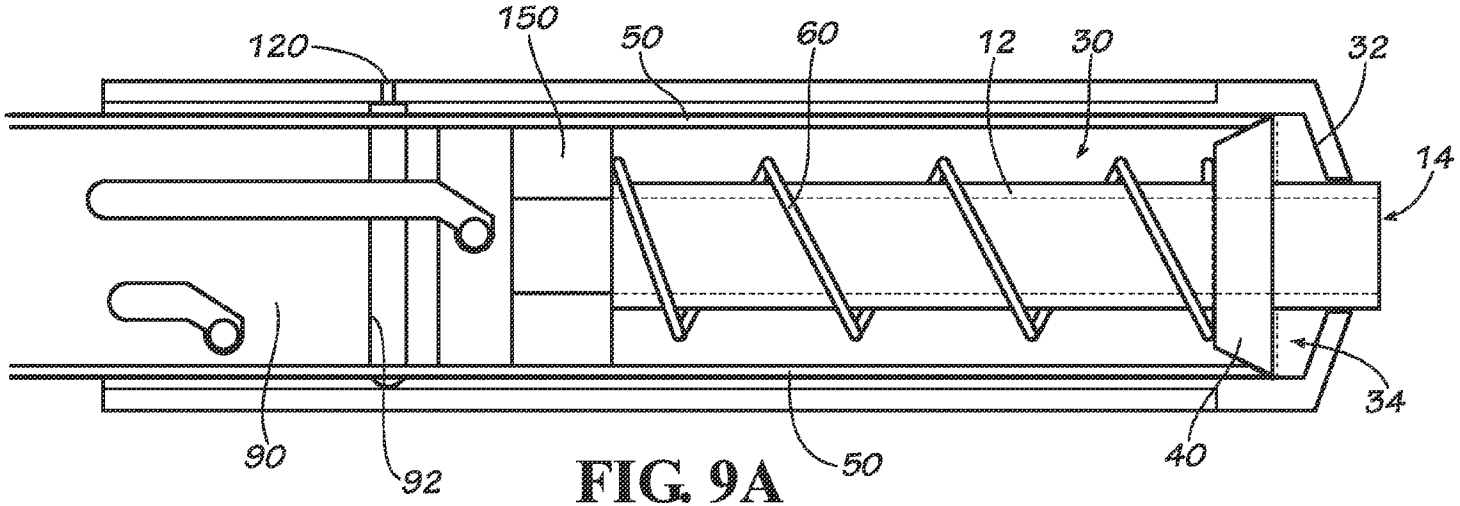
FIG. 9A shows a top view of the bolt in FIGS. 8A-8C in a closed state.
Figure 9B:
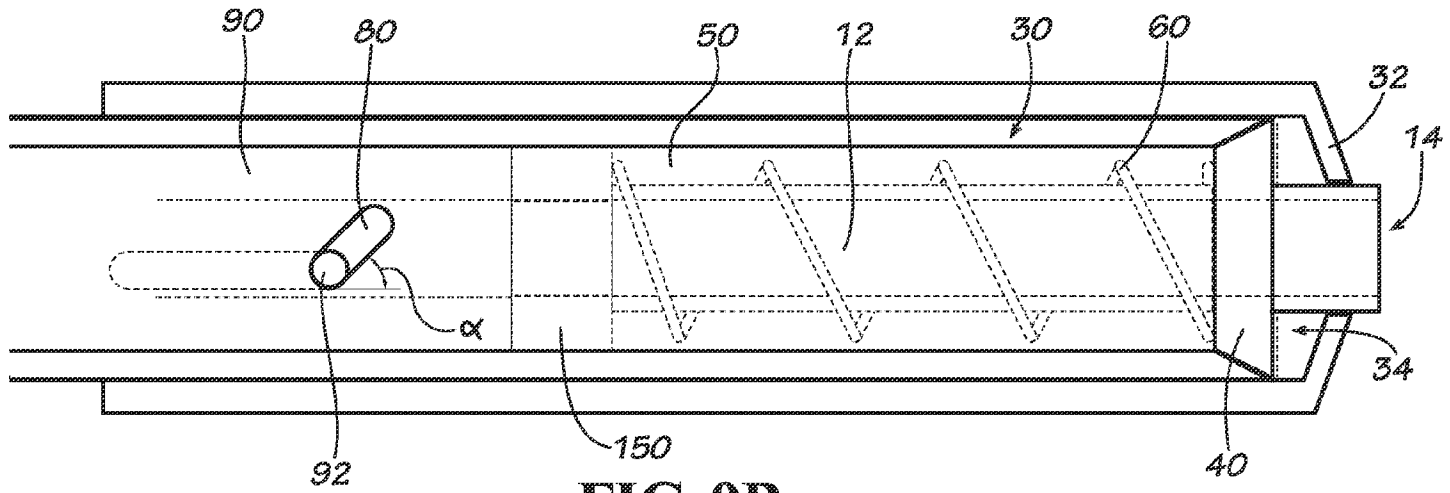
FIG. 9B shows a side view of the bolt in FIGS. 8A-8C in a closed state.
Figure 10A:
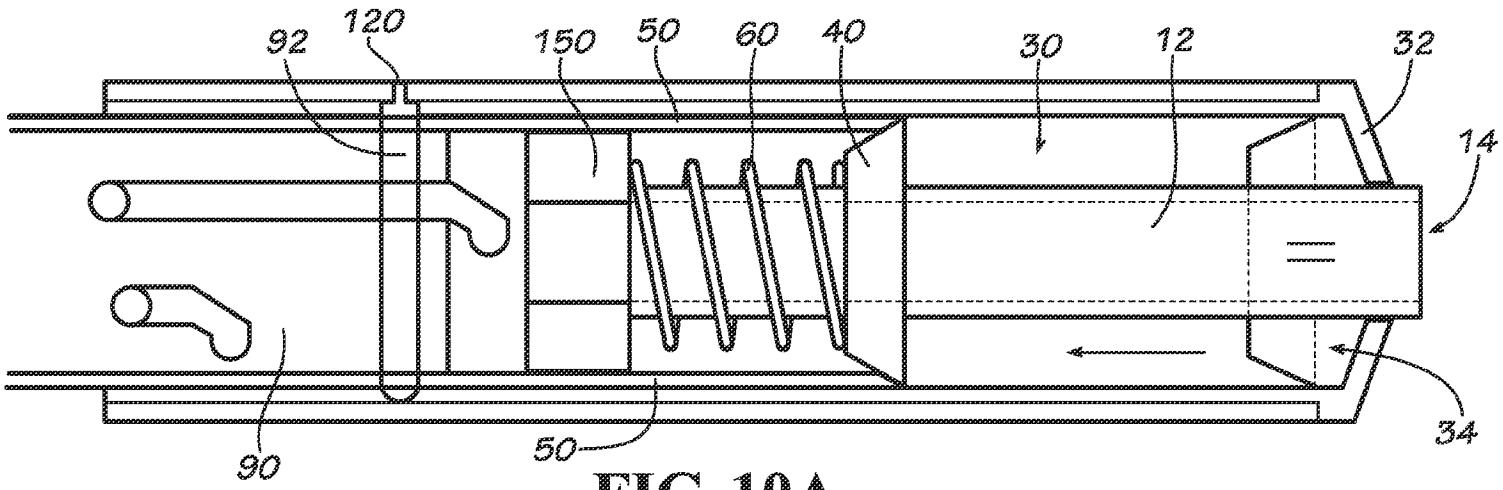
FIG. 10A shows a top view of the bolt in FIGS. 8A-8C in an open state.
Figure 10B:
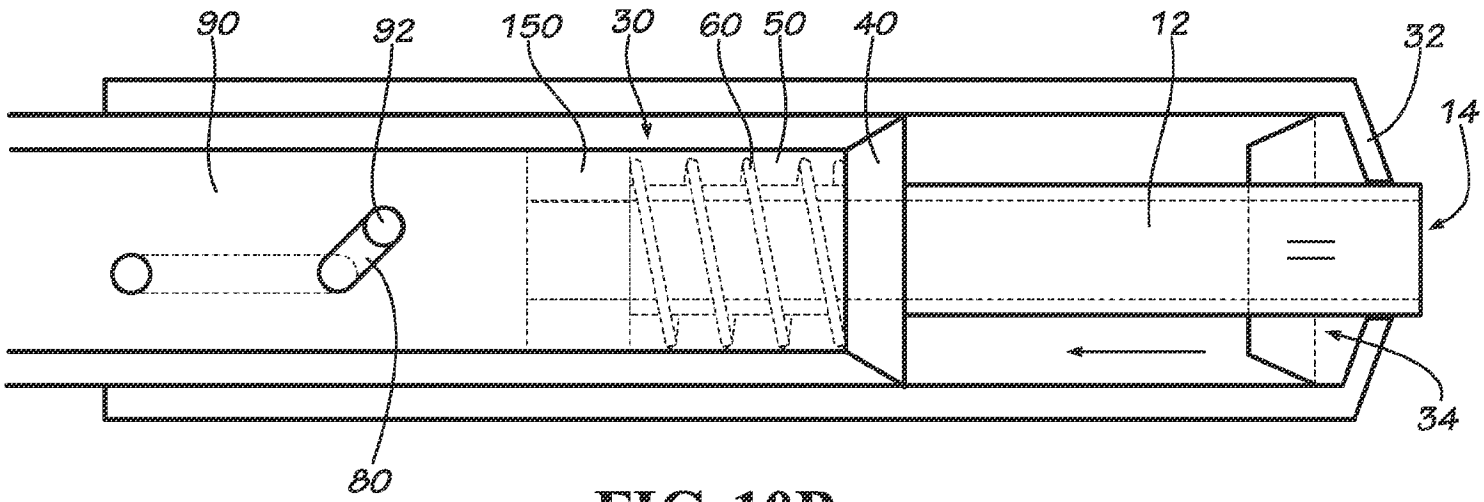
FIG. 10B shows a side view of the bolt in FIGS. 8A-8C in an open state.

FIGS. 9A-9B and 10A-10B show a sequence of operation, with FIGS. 9A & 9B showing the gas cup 40 and slide rails 50 in an advanced or resting position toward the muzzle end 14, and the bolt retainer pin 92 in a first position within the aperture 80; and FIGS. 10A & 10B showing the gas cup and slide rails in a retracted or firing position moving away from the muzzle end, and the bolt retainer pin in a second position within the aperture and angularly offset from the first position.

Figure 3:
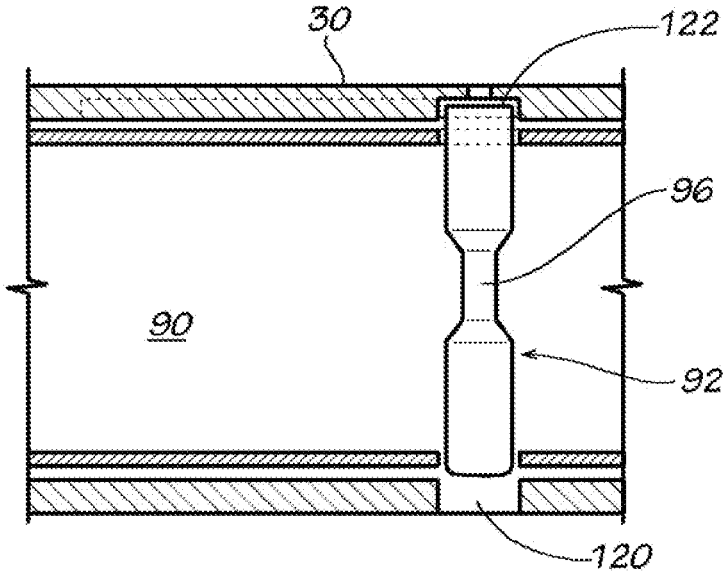
FIG. 3 shows an interior bolt retainer assembly according to an example embodiment of the present invention.
Figure 4:
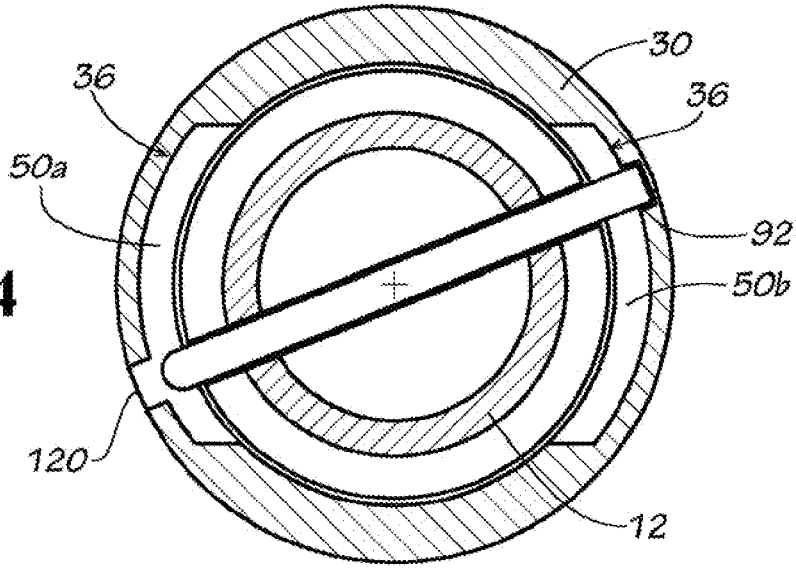
FIG. 4 shows a cross-sectional assembly view of a portion of a firearm according to an example embodiment of the present invention.
Figure 8A:
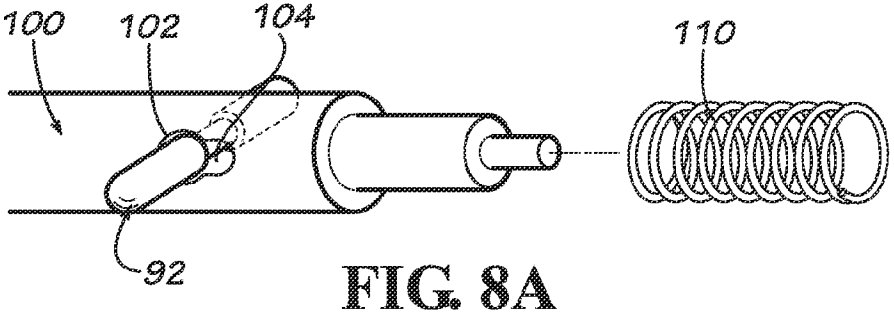
FIG. 8A shows a spring-loaded firing pin assembly.
Figure 8B:
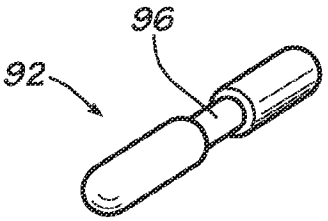
FIG. 8B shows a bolt retainer for use with the bolt and firing pin assembly of FIG. 8A.
Figure 8C:
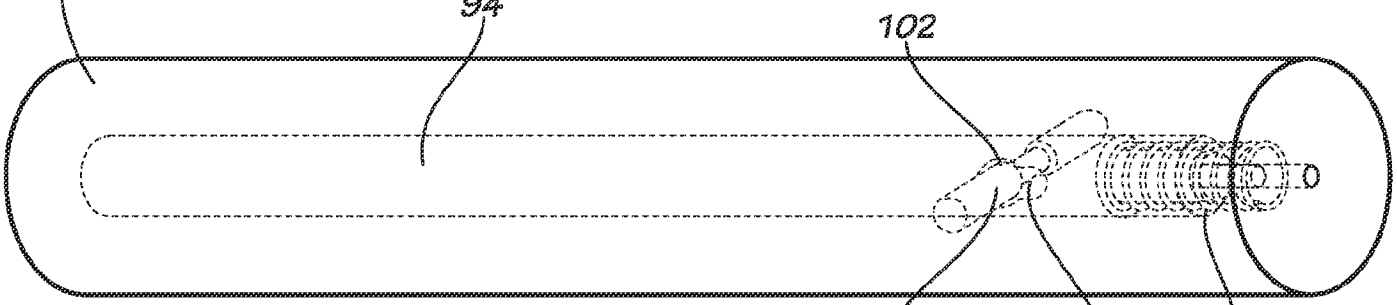
FIG. 8C shows the firing pin assembly of FIG. 8A within a bolt.

The bolt retainer 92 shown in FIGS. 4 and 8B-8C optionally also functions to retain a rebounding firing pin 100 (FIG. 8A) within a lengthwise bore 94 (FIG. 8C) through the bolt 90. The firing pin 100 preferably has a shorter length than the bolt 90, and has a bore 102 extending transversely therethrough with a keyway 104 for retaining a reduced-diameter engagement portion 96 of the bolt retainer 92 positively engaged therein under the bias of a firing pin spring 110 acting in compression between a forward face of the firing pin and a rearward face or shoulder of the bolt bore 94. As shown in FIGS. 3 & 4 an access opening 120 is provided in one side of the pressure tube or receiver 30 to permit insertion and removal of the bolt retainer for assembly and disassembly, and a channel 122 is formed in the opposite side of the inner face of the pressure tube 30 for receiving and guiding the end of the bolt retainer. A smaller opening is provided for using a sharp object to push the retainer pin 92 out of the bolt and through the access opening 120 when the firing pin is retracted, to allow disassembly of the firearm. The bolt retainer pin 92 is shown to extend through the rail yoke 50 and the bolt 90 and is supported by the firing pin 100 (FIG. 8A) and is inserted into the aperture groove 80.

Figure 7E:
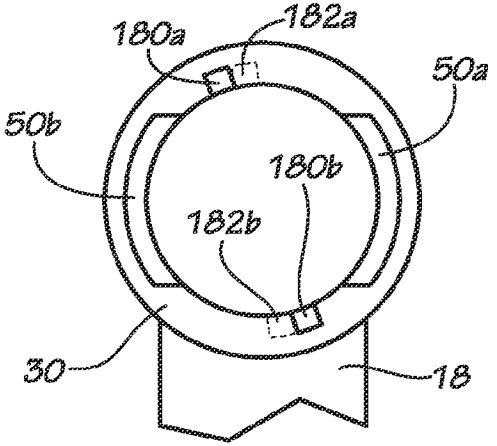
FIG. 7E shows a side cross-sectional view of an alternative example embodiment bolt locking assembly.

The bolt 90 preferably further comprises one or more locking elements for engaging and disengaging cooperating engagement features of the firearm to lock the bolt in a forward or "in-battery" position during firing, and release the bolt for retraction to extract and eject a spent cartridge casing and rack a new round into the chamber of the barrel, providing a locked-breech action. In one example embodiment shown in FIGS. 7A-7B, a plurality of machined bolt lugs 140 extend from the front face of the bolt 90 for cooperative engagement and disengagement with matching ports in the breech block 150. In the depicted embodiment, three bolt lugs 140 are spaced about the circumference of the bolt 90. An extractor 160 and spring-loaded ejector mechanism 162 are preferably also provided along the forward end of the bolt 90. In an alternate embodiment shown in FIGS. 7B-7D, two large locking lugs 170*a*, 170*b* engage and disengage forward and rearward ports 172*a*, 172*b* formed in the receiver portion of the pressure tube 30 proximal the breech opening 26 of the firearm. And in still another embodiment shown in FIG. 7E, locking lugs 180*a*, 180*b* engage and disengage ports 182*a*, 182*b* formed in the inner face of the pressure tube 30 above and below the bolt for a more balanced lock-up. The locking elements of the bolt and the cooperating engagement features are preferably angularly oriented to match the angle of inclination $\alpha$ of the contact surface of the aperture 80 of the slide rails 50, such that the rotation of the bolt imparted by the rearward actuation of the slide rails upon firing serves to engage and disengage the locking elements.

Optionally, a pistol grip 18, forend grip and/or a folding stock can be affixed to the pressure tube 30, and the barrel and/or pressure tube extended to provide a carbine type of firearm. Because the barrel and pressure tube are fixed and do not reciprocate as do the slides of other automatic pistols, the pressure tube allows for a fixed mounting position for such features, as well as for sights or other accessories.

In operation, the user chambers an initial round by retracting the slide rails 50 via the exposed serrated portions 52 at the rear end of the slide rails at the rear of the weapon to load a cartridge from the magazine of the firearm into the chamber of the barrel. The rear ends 52 of the slide rails are optionally folded and/or ribbed or otherwise textured to provide the user with a better gripping surface. Upon firing the firearm, the propellant gasses expand to discharge the bullet from the barrel 12. As the bullet passes the barrel vents 70, the propellant gasses pressurize the gas pressure chamber within the pressure tube 30, and drive the gas cup 40 and attached slide rails 50 rearward. As the slide rails 50 are driven rearward, the contact surfaces of the slide rail apertures acting on the bolt retainer pin causes the bolt 90 to rotate and disengage the locking elements of the bolt. Continued rearward movement of the gas cup 40 and slide rails 50 moves the disengaged bolt 90 rearward in the receiver, ejecting the spent cartridge casing, and cocking the hammer into single-action mode. After reaching the rearward extent of travel of the bolt 90, remaining pressure may be released to the atmosphere by one or more vents 70 in the pressure tube 30, allowing the bolt, gas cup 40 and slide rails 50 to return forward under the bias of barrel spring. As the bolt 90 advances back toward its closed or battery position, a new cartridge is automatically engaged and racked from the magazine into the chamber, ready to repeat the firing sequence.

In example forms of the invention, the firearm's operating mechanism can be disassembled and assembled without tools. Disassembly of the firing mechanism may be achieved by pressing the firing pin forward in front of the hammer, using a bullet nose or other pointed object to push the bolt retainer pin through the aperture 120 in the side of the pressure tube 30, and pulling the retainer pin out manually through the side of the tube. This releases the bolt 90, firing pin and firing pin spring, which can be retrieved through the back of the bolt, all of which are removed through the back of the tube. The gas cup 40 and slide rail 50 assembly and the recoil spring can be removed through the front of the tube by unscrewing the forward muzzle cap 32 and simply pulling out the cup and slide assembly (which has been released from the bolt by removal of the bolt retainer pin as described above) forward through the front of the pressure tube 30 along with the recoil spring. The sequence is reversed for assembly.

While the invention has been described with reference to preferred and example embodiments, it will be understood by those skilled in the art that a variety of modifications, additions and deletions are within the scope of the invention, as defined by the following claims.

The invention claimed is:

1. A firearm comprising:

a barrel having a bore extending therethrough and defining a central lengthwise barrel axis through the bore, and a chamber on one end configured to receive a loaded round of ammunition;

a cylindrical pressure tube surrounding the barrel and having a pressure tube axis coincident with the barrel axis; and a muzzle cap secured around a forward end of the barrel and a breech block secured around a breech end of the barrel thereby forming an annular enclosure between the interior of the pressure tube and the exterior of the barrel.

2. The firearm of claim 1, further comprising a gas cup having an outer rim for sliding in proximity with the inner surface of the pressure tube, and an inner opening for sliding in proximity with an external surface of the barrel.

3. The firearm of claim 2, further comprising a pair of slide rails extending from the gas cup through an internal portion of the pressure tube.

4. A firearm comprising a barrel concentrically mounted within a pressure tube, the pressure tube forming an enclosure within which a bolt moveable between an advanced position in engagement with a breech end of the barrel for firing of the firearm and a retracted position away from the breech end of the barrel for discharge of a spent cartridge casing.

5. The firearm of claim 4, comprising a fixed barrel firearm.

6. The firearm of claim 4, further comprising a gas cup reciprocating under the influence of propellant gas pressure vented from the barrel into the pressure tube when the firearm is fired.

7. The firearm of claim 6, wherein the gas cup further comprises slide members that link the gas cup to the bolt.

8. A locked-breech action firearm comprising:

a barrel having a breech end, a muzzle end, and an internal bore;

a pressure tube surrounding the barrel;

an annular space between an outer surface of the barrel and an inner surface of the pressure tube, the annular space is configured to facilitate the movement of at least a portion of an operating mechanism of the firearm therein; and a bolt movable upon operation thereon by the firearm's operating mechanism between an advanced position in engagement with the breech end of the barrel for firing of the firearm, and a retracted position away from the breech end of the barrel for discharge of a spent cartridge casing, the bolt including one or more locking elements for engaging and disengaging cooperating engagement features of the firearm to lock the bolt in a forward position during firing.

9. The firearm of claim 8 further comprised of a bolt retainer pin extending through the bolt, wherein the bolt retainer pin has a first end sliding in a guide slot formed in the inner surface of the pressure tube.

10. The firearm of claim 9, wherein the bolt retainer pin retains a firing pin within the bolt.

11. The firearm of claim 10, wherein the firing pin retains the bolt retainer pin within the bolt.

12. The firearm of claim 8 wherein the one or more locking elements are bolt lugs that extend from a front face of the bolt, and the cooperating engagement features of the firearm are ports in a breech block located adjacent the breech end of the barrel.

13. The firearm of claim 12, wherein the front face of the bolt includes three bolt lugs.

14. The firearm of claim 8 wherein the one or more locking elements are locking lugs, and the cooperating engagement features of the firearm are comprised of a forward port and a rearward port, the forward port and the rearward port are formed in the pressure tube proximate the breech end of the barrel.

15. The firearm of claim 8 wherein the one or more locking elements are two locking lugs, and the cooperating engagement features of the firearm are comprised of a first port and a second port formed in an inner face of the pressure tube, wherein the first port is located above the bolt and the second port is located below the bolt for a more balanced lock-up.

16. The firearm of claim 3, further comprising guide channels extending lengthwise along the inner surface of the pressure tube configured to receive and guide the slide rails of the gas cup.

* * * * *